US005671984A

United States Patent [19]

Kodera

[11] Patent Number: 5,671,984

[45] Date of Patent: Sep. 30, 1997

[54] EXHIBITION APPARATUS

[75] Inventor: Hiroyuki Kodera, Saitama-ken, Japan

[73] Assignee: Showa Koki Co., Ltd., Itabashi, Japan

[21] Appl. No.: 674,668

[22] Filed: Jul. 2, 1996

[30] Foreign Application Priority Data

Jan. 22, 1996 [JP] Japan ..... 8-027350

[51] Int. Cl.[6] ..... A47F 3/00; F16M 13/00

[52] U.S. Cl. ..... 312/114; 312/4; 312/319.1; 248/550; 52/167.2; 160/2; 160/84.05; 109/81

[58] Field of Search ..... 312/3, 4, 114, 312/319.1, 272, 272.5, 284; 248/550, 636; 52/167.1, 167.2, 167.4; 160/2, 84.05, 40, 370.21; 109/9, 11, 12, 81

[56] References Cited

U.S. PATENT DOCUMENTS

| | | | |
|---|---|---|---|
| 1,747,655 | 2/1930 | Wright | 109/11 X |
| 4,500,145 | 2/1985 | Fassauer | 312/272 X |
| 4,749,241 | 6/1988 | Thoresen et al. | 312/114 |
| 4,801,122 | 1/1989 | Stahl | 248/636 X |
| 5,035,394 | 7/1991 | Haak | 248/636 X |
| 5,082,316 | 1/1992 | Wardlaw | 292/201 X |
| 5,125,726 | 6/1992 | Hahn et al. | 312/114 |
| 5,127,718 | 7/1992 | Paine et al. | 312/114 |
| 5,242,206 | 9/1993 | Heck | 160/370.21 X |
| 5,325,970 | 7/1994 | Dillon et al. | 206/576 X |
| 5,535,808 | 7/1996 | Idesis et al. | 160/311 X |

*Primary Examiner*—Peter M. Cuomo
*Assistant Examiner*—James O. Hansen
*Attorney, Agent, or Firm*—Fish & Richardson P.C.

[57] ABSTRACT

A protective member is disposed in a contracted state thereof within an exhibition case for an exhibition apparatus. When a larger shaking of the exhibition case than a predetermined level is detected by a detector, an actuation mechanism expands the protective member in response to the detection of shaking. The protective member thus expanded surrounds an exhibit.

9 Claims, 6 Drawing Sheets

EXHIBITION APPARATUS

BACKGROUND OF THE INVENTION

This invention relates to an exhibition apparatus for safely exhibiting such exhibits as Buddhist images or the like.

In an art museum and the like, exhibits are usually put into individual exhibition cases and exhibited. It is a usual practice that those exhibition cases are merely secured to the floor. For this reason, there is a fear that when a large earthquake occurs or the like, the exhibition cases are shaken so hard to cause, in some instances, the exhibits to be fallen. The result is that the exhibits are broken.

Recently, there was developed an apparatus which is designed to be interposed between the floor and the exhibition case to reduce the degree of shaking of the exhibition case when an earthquake occurs. However, when a huge earthquake occurs, this apparatus is not good enough to reduce the degree of shaking of the exhibition case to the extent of satisfaction. In other words, with this conventional apparatus, it is difficult to assuredly prevent the exhibit from falling and breaking.

SUMMARY OF THE INVENTION

It is, therefore, an object of the present invention to provide an exhibition apparatus which can assuredly prevent exhibits from breaking, which breaking would otherwise occur due to earthquake or the like.

According to the present invention, there is provided an exhibition apparatus comprising:

(a) an exhibition case having a peripheral wall surrounding an exhibit;

(b) expansible protective means disposed in a contracted state thereof selectively at an upper part or a lower part of the exhibition case and inwardly of the peripheral wall of the exhibition case, the protective means surrounding the exhibit when the protective means expands in a vertical direction;

(c) detection means for detecting a larger shaking of the exhibit case than a predetermined level; and (d) actuation means for expanding the protective means in response to the detection of shaking made by the detection means.

DETAILED DESCRIPTION OF THE EMBODIMENTS

Figure 1:
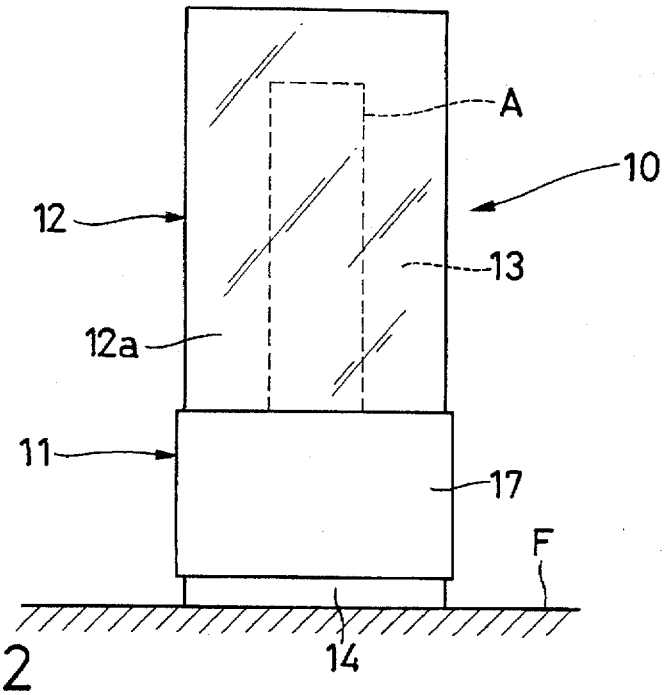
FIG. 1 is a side view showing one embodiment of an exhibition apparatus according to the present invention.

One embodiment of an exhibition apparatus according to the present invention will now be described with reference to FIGS. 1 through 7. As shown in FIG. 1, the exhibition apparatus includes an exhibition case 10 for receiving an exhibit A such as a Buddhist image. This exhibition case 10 includes a base 11 on which the exhibit A is placed, and a transparent case body 12 supported by the peripheral edge of the base 11 and adapted to encase the exhibits A. The base 11 and the case body 12 define an exhibition space 13 for receiving therein the exhibit A.

Figure 3:
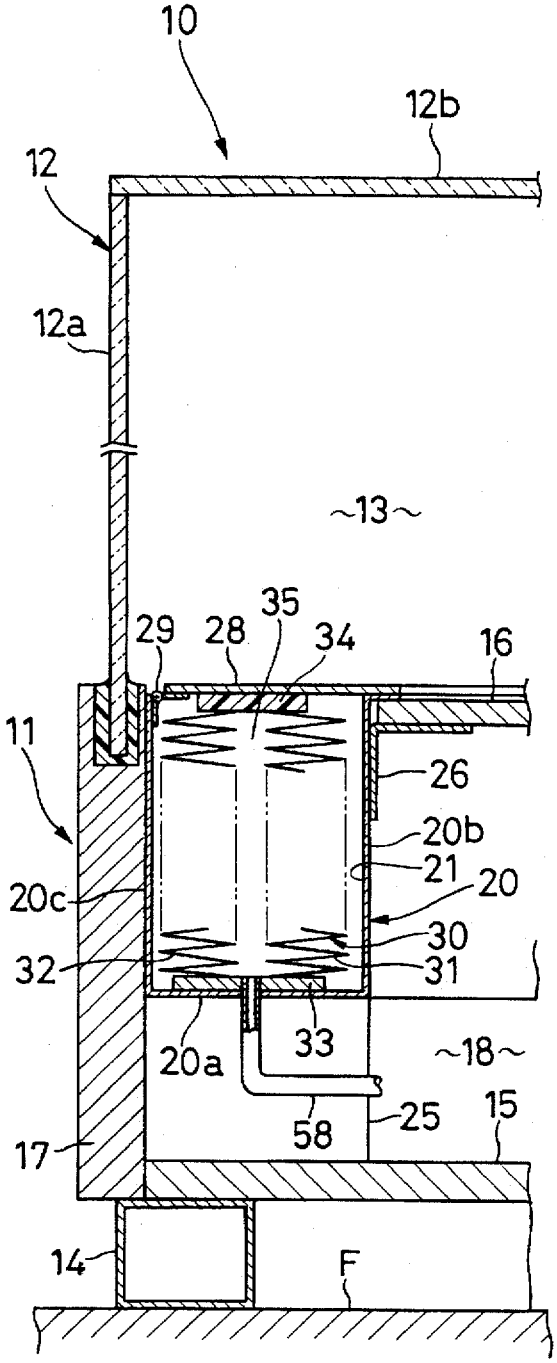
FIG. 3 is an enlarged vertical sectional view showing the protective member in its contracted state.
Figure 4:
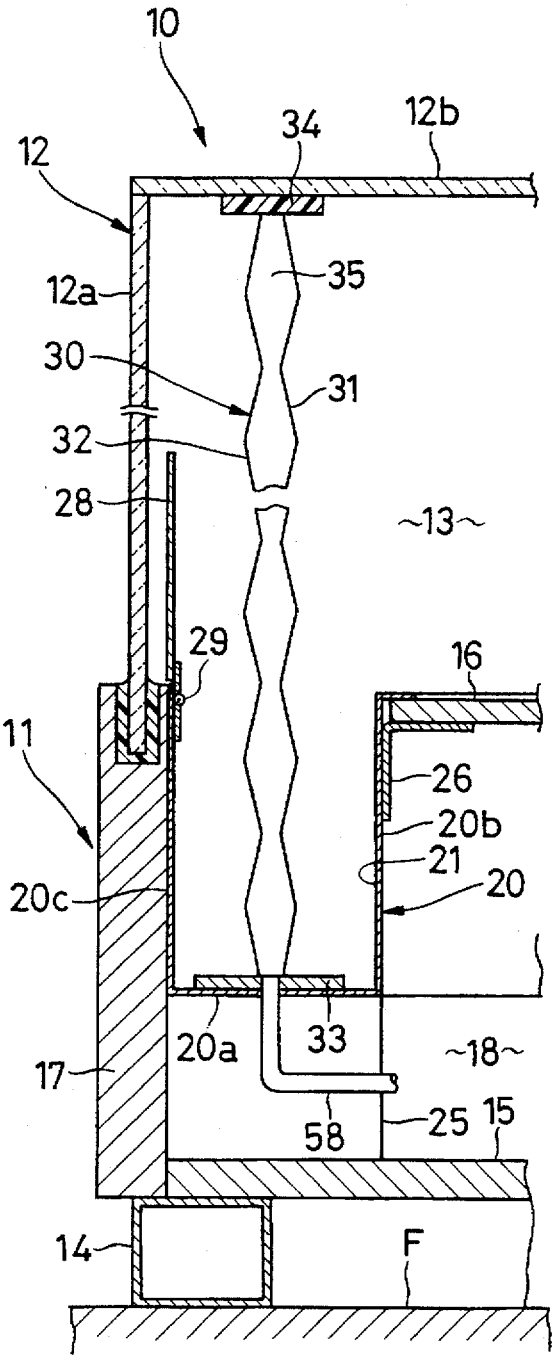
FIG. 4 is a view, similar to FIG. 3, showing the protective member but in its expanded state.

As shown in FIGS. 3 and 4, the base 11 includes a basal frame 14 having a square configuration in plan view, a square lower plate 15 secured in its horizontal posture to an upper surface of the basal frame 14, a square upper plate 16 disposed in its horizontal posture upwardly of the lower plate 15, and four square side plates 17 (only one side plate is shown) disposed in its vertical posture upwardly of the basal frame 14. An internal space 18 of the base 11 is defined by the lower plate 15, the upper plate 16 and the side plates 17. The basal frame 14 has a hollow interior of a square configuration in section and is secured to a floor surface F by bolts (not shown) or the like. Three of the four side plates 17 are secured to the basal frame 14 and also to each other. The remaining side plate 17 is pivotally connected to a side edge of one of adjacent side plates 17 by a hinge (not shown). In the state that the internal space 18 in the base 11 is closed by this pivotable side plate 17, the pivotable side plate 17 is locked to the other adjacent side plate 17 through a lock mechanism (not shown).

As shown in FIGS. 3 and 4, the case body 12 comprises four square side plates **12*a* (only one side plate is shown), and a square upper plate 12*b*. The four side plates 12*a* constitute a peripheral wall having a square configuration in cross section. The four side plates 12*a* and the upper plate 12*b* are made of transparent material having a large strength such as glass or resin. It should be noted that all the four side plates 12*a*** are not necessarily be transparent but at least one of them should be transparent.

Lower edges of the three side plates **12*a* of the case body 12 are secured to upper edges of the first-mentioned three side plates 17 in the base 11. The upper plate 12*b* is secured to upper edges of the three side plates 12*a*. Those three side plates 12*a* are secured at side edges thereof to each other. An upper edge of the remaining pivotable side plate 17 of the base 11 is also secured to a lower edge of the remaining side plate 12*a* of the case body 12. This side plate 12*a* can pivot together with the side plate 17 just mentioned. By doing this, the exhibition space 13 can be opened/closed so that the exhibit A can be put into and out of the space 13**.

The base 11 has a receiving member 20. This receiving member 20 is like a ring having a square configuration in plan view and arranged along the four side plates 17. The receiving member 20 has a generally U-shaped configuration in vertical section. The receiving member 20 includes a flat bottom wall **20*a*, an inner erected wall 20*b* and an outer erected wall 20*c* which erected walls extend upwardly. The bottom wall 20*a* of the receiving member 20 is secured to the lower plate 15 through a block 25**.

The upper plate 16 has a smaller area than the lower plate 15. An outer peripheral edge of the upper plate 16 is secured to the inner erected wall 20b through a bracket 26. The exhibit A is placed on a central portion of an upper surface of the upper plate 16. The upper surface of the upper plate 16 is generally flush with an upper end of the receiving member 20. An internal space of the receiving member 20 is provided as a receiving recess 21 for receiving a protective member 30 (protective means) as later described. An upper end opening of this receiving recess 21 is covered with closures 28. Each closure 28 is pivotably connected to an upper edge of the outer erected wall 20c of the receiving member 20 by a hinge 29. Normally, the closures 28 are placed on an upper edge of the inner erected wall 20b in such a manner as to close the upper opening of the receiving recess 21.

Figure 2:
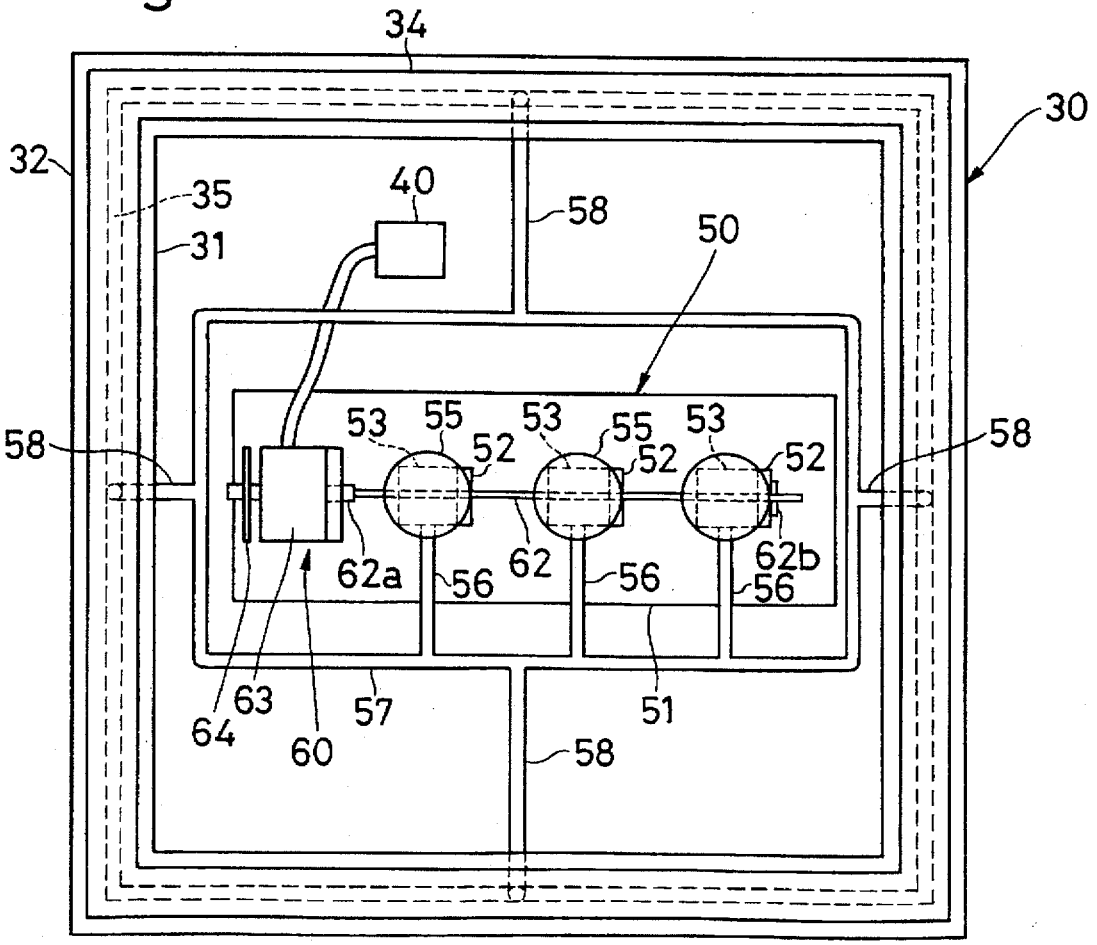
FIG. 2 is a plan view showing a protective member and an actuation mechanism of the exhibition apparatus.

As shown in FIGS. 2 through 4, the protective member 30 includes a sleeve-like inner bellows 31 having a square configuration in plan view, a sleeve-like outer bellows 32 having a larger square configuration in plan view than the inner bellows 31 and surrounding the inner bellows 31, a lower connecting plate 33 for connecting lower ends of the inner and outer bellows 31 and 32 together, and an upper connecting plate 34 for connecting upper ends of the inner and outer bellows 31 and 32 together. The inner and outer bellows 31 and 32 are spaced apart from each other. A closed space 35 is defined by the bellows 31 and 32 and the connecting plates 33 and 34. In other words, the protective member 30 takes the form of a ring-like bag having a square configuration in plan view.

The bellows 31 and 32 are obtained by forming a sheet made of comparatively soft material such as rubber, synthetic resin or cloth coated with rubber or synthetic resin into a sleeve-like form and then forming a plurality of bending scores on its surface in order to achieve an accordion-like form. As a consequence, the protective member 30 can be expanded and contracted in a vertical direction. Usually, the protective member 30 is received in a folded or contracted state thereof in the receiving recess 21. The lower connecting plate 33 is secured to a bottom surface of the receiving member 20. An upper connecting plate 34 is made of comparatively soft material such as soft resin, rubber or the like. In FIG. 3, the upper connecting plate 34 of the contracted protective member is in contact with the closure 28. It should be noted, however, that the upper connecting plate 34 may of course be spaced apart from the closure 28.

As shown in FIG. 2, the exhibition apparatus according to the present invention further includes a detector 40 (detection means) for detecting a larger shaking of the exhibition case 10 than a predetermined level as at the time of earthquake and outputting an electrical detection signal, and an actuation mechanism 50 (actuation means) for expanding the protective member 30 upwardly in response to the detection signal from the detector 40. The detector 40 and the actuation mechanism 50 are received in the internal space 18 of the base 11.

Figure 5:
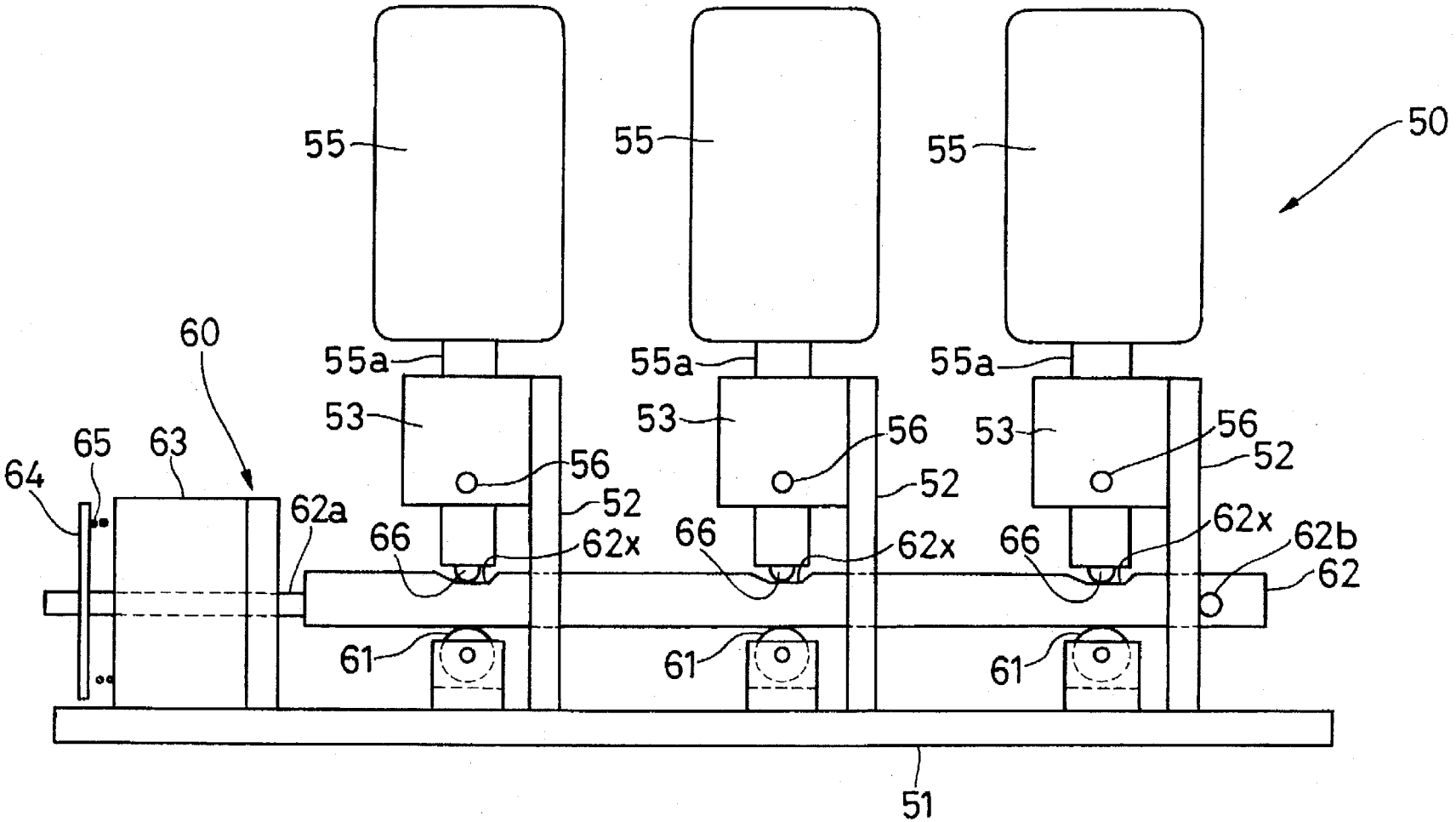
FIG. 5 is a side view of the actuation mechanism.

As shown in FIGS. 2 and 5, the actuation mechanism 50 has an elongated base plate 51 secured to an upper surface of the lower plate 15 of the base 11. A plurality (for example, three) of support posts 52 linearly fixedly arranged on an upper surface in a longitudinal direction of the base plate 51. Each support post 52 is formed of an elongated plate, and a sleeve-like holder 53 is secured in its vertical posture to an upper end portion of each support post 52. A high-pressure tank (high-pressure gas supply source) 55 is mounted on this holder 53.

Figure 6:
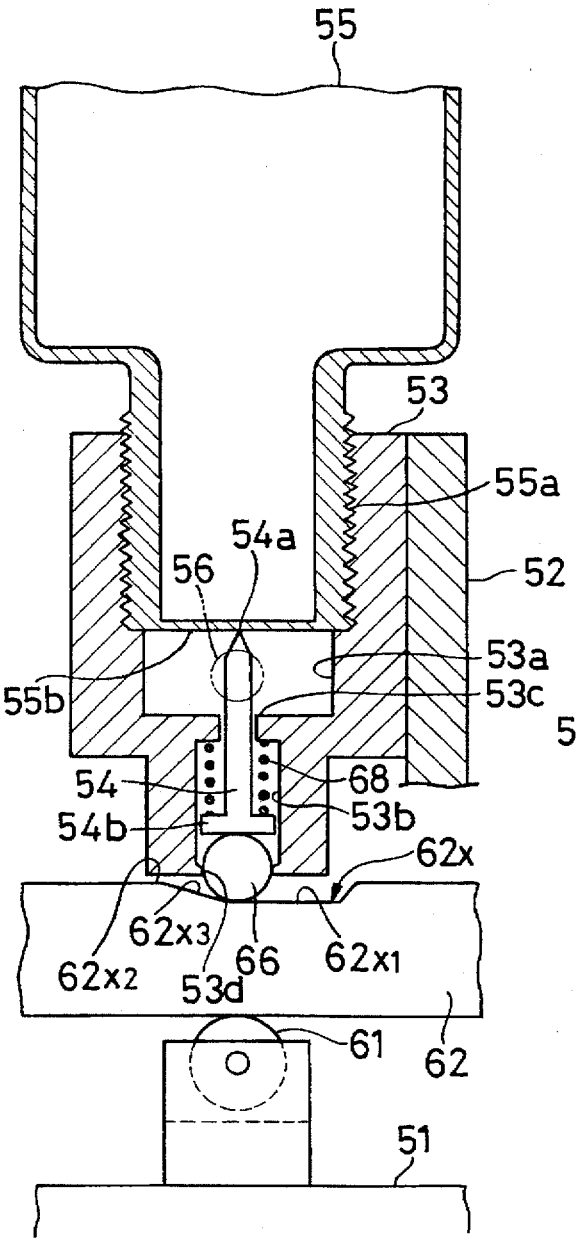
FIG. 6 is an enlarged vertical sectional view showing a main part of the actuation mechanism in its non-operating state.
Figure 7:
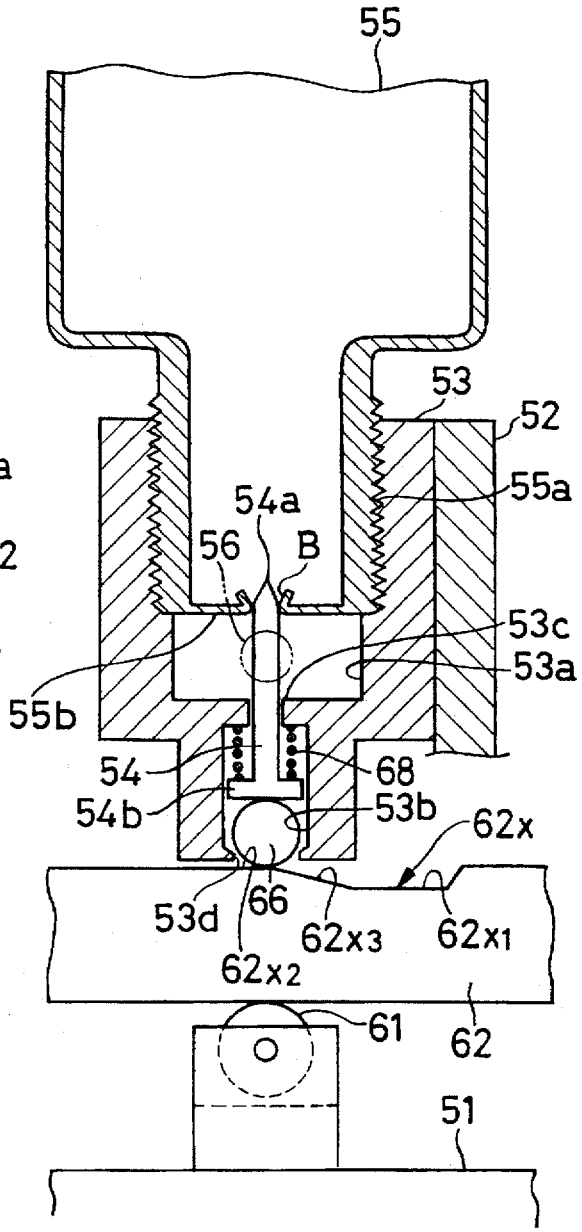
FIG. 7 is a view, similar to FIG. 6, showing the main part of the actuation mechanism but in its operating state.

As best shown in FIGS. 6 and 7, the holder 53 includes a first receiving space 53a having a circular configuration in section and a second receiving space 53b having likewise a circular configuration in section, the former being open at an upper end thereof and the latter being open at a lower end thereof. The diameter of the second receiving space 53b is smaller than the first receiving space 53a. An annular spring retainer 53c is formed on a boundary between the first and second receiving spaces 53a and 53b. An annular engagement portion 53d is formed on a lower end peripheral edge of the second receiving space 53b.

The high-pressure tank 55 is a molding made of metal such as iron and has a sleeve-like configuration. This tank 55 contains therein a high-pressure gas such as air, nitrogenous gas, or carbon dioxide gas. This high-pressure tank 55 does not have an opening nor a closure for closing the opening. A lower end portion 55a of a reduced diameter of the high-pressure tank 55 is threadingly inserted into the first receiving space 53a. A thin lower end wall 55b (thin wall portion) of the high-pressure tank 55 is spacedly opposite the spring retainer 53c.

The three holders 53 are connected respectively with one ends of tubes 56 which are in communication with a lower portion (an internal space defined by the holder 53 and the lower end wall 55b of the high-pressure tank 55) of the first receiving space 53a. The other ends of those three tubes 56 are connected to a common tube 57. The tube 57 is connected with one ends of four tubes 58. As shown in FIGS. 2 and 6, the other ends of those tubes 58 extend through the bottom wall 20a of the receiving member 20 and the lower connecting plate 33 of the protective member 30 at the center of each side of the receiving member 20 having a square configuration in plan view and are in communication with the closed space 35 in the protective member 30. In this way, the lower portion of the first receiving space 53a is in communication with the closed space 35 of the protective member 30 through the tubes 56, 57 and 58.

As shown in FIG. 6, a needle 54 for piercing the tank 55 for discharging a high-pressure gas from the tank 55 is received in a vertical state thereof in each holder 55. A gap between an outer peripheral surface of the needle 54 and an inner peripheral surface of the spring retainer 53c of the holder 53 is very small, or a seal member is interposed therebetween, so that leak of the high-pressure gas, as later described, from between the needle 54 and the spring retainer 53c is minimized. A sharp upper end 54a of the needle 54 is located on the lower portion of the first receiving recess 53a and opposite the lower end wall 55b of the high-pressure tank 55. The needle 54 is provided at a lower end thereof with a spring retainer 54b. The spring retainer 54b is disposed within the second receiving space 53b.

A moving mechanism 60 for moving the needle 54 will now be described in detail. As shown in FIG. 5, the moving mechanism 60 has a plurality (for example, three) of rollers 61 arranged in the same direction as the arrangement of the support posts 52. Those rollers 61 are rotatably supported on an upper surface of the base plate 51. An elongated cam rod 62, which is allowed to pierce through the support posts 52 and extend in a direction of an arrangement of the rollers 61, is placed on the rollers 61. On an upper surface of one end portion (left-hand side in FIG. 5) of the base plate 51, an electromagnetic driver 63 having therein a solenoid is installed. One end of the cam rod 62 is connected with a shaft 62a. This shaft 62a is allowed to pierce through the electromagnetic driver 63 and extends in a longitudinal direction of the cam rod 62. An armature 64 is attached to a projecting end of the shaft 62a. A coil spring 65 is interposed between the armature 64 and the electromagnetic driver 63. The coil spring 65 is adapted to bias the cam rod 62 in the left direction of FIG. 5. A stopper 62*b* is mounted on a right-hand end of the cam rod 62. Since this stopper 62*b* hits the support post 52 on the right-hand end, further movement of the cam rod 62 in the left direction is restricted.

As shown in FIGS. 6 and 7, the moving mechanism 60 further includes a cam follower 66 and a coil spring 68 which are received in the second receiving space 53*b* in the holder 53. The coil spring 68 is loaded in a contracted state thereof between the spring retainer 54*b* of the needle 54 and the spring retainer 53*c* of the holder 53. The cam follower 66 has a ball-like configuration. The cam follower 66 is urged downwardly by the coil spring 68 through the spring retainer 54*b* of the needle 54 and projects from a lower end face of the holder 53. The cam follower 66 is engaged with the engagement portion 53*d* of the holder 53 so that the cam follower 66 may not escape from the holder 53.

On an upper surface of the cam rod 62, a cam surface 62*x* for the cam follower 66 to contact is formed. This cam surface 62*x* includes a low horizontal portion $62x_1$, a high horizontal portion $62x_2$ and an inclination portion $62x_3$ disposed therebetween. Normally, as shown in FIG. 6, the cam follower 66 is in contact with the low horizontal portion $62x_1$ of the cam surface 62*x* of the cam rod 62, and the upper end 54*a* of the needle 54 is slightly spaced apart from the lower end wall 55*b* of the high-pressure tank 55.

With the above-mentioned construction, in a normal exhibition state, as shown in FIG. 3, the protective member 30 is in a contracted state thereof and the receiving recess 21 is closed by the closure 28. Since this closure 28 is located at a level generally equal to the upper plate 16 of the base 11, the exhibit A can be exhibited in the same manner as in the ordinary exhibition case. The protective member 30 does not obstruct the view.

When the exhibition case 10 is shaken hard exceeding the predetermined level as at the time of earthquake, the detector 40 detects this shaking and outputs an electric detection signal to the electromagnetic driver 63. In response to this electric detection signal from the detector 40, the electromagnetic driver 63 is turned on to draw the armature 64 against the effect of the coil spring 65. As a consequence, the cam rod 62 moves in the right direction in FIGS. 5 and 6, and the cam surface 62*x* moves in the same direction with respect to the cam follower 66. Consequently, a contact position of the cam follower 66 with respect to the cam surface 62*x* is shifted from the low horizontal portion $62x_1$ to the high horizontal portion $62x_2$ via the inclination portion $62x_2$. Accordingly, the cam follower 66 is moved upwardly.

Since the upwardly moved cam follower 66 pushes the needle 54 upwardly against the effect of the coil spring 68, the upper end 54*a* of the needle 54 pierces through the thin lower end wall 55*b* of the high-pressure tank 55 to form a hole B as shown in FIG. 7. As a result, the high-pressure gas within the high-pressure tank 55 leaks through the hole B at the lower end wall 55*b* to fill the lower portion of the first receiving space 53*a*. The high-pressure gas is then supplied into the closed space 35 in the protective member 30 through the tubes 56 through 58.

When the high-pressure gas is introduced as mentioned, the protective member 30, as shown in FIG. 4, push-opens the closure 28 and expands upwardly in a sleeve-like form having a square configuration in plan view along the four side plates 12*a* of the case body 12, while surrounding the entire periphery of the exhibit A which is placed on the upper plate 16 of the base 11. Accordingly, even if the exhibit A should be accidentally fallen, it would be safely received by the protective member 30, thus preventing the exhibit A from being broken.

Especially, in this embodiment, since the high-pressure gas within the protective member 30 serves as a cushion for receiving the exhibit A, the exhibit A can more assuredly be prevented from being broken. Further, since the protective member 30 has the bellows 31 and 32, the bellows 31 and 32 themselves also serve as cushions, thus contributing to prevent the exhibit A from being broken.

The bellows 31 and 32 are readily expanded and contracted and easily received in a contracted state thereof in the receiving recess 21. When a high-pressure gas is supplied to the bellows 31 and 32, the bellows 31 and 32 are rapidly and assuredly expanded to surround the exhibit A. Further, since the high-pressure is introduced into the protective member 30 from the four places, the protective member 30 can expand in a stable manner.

When the protective member 30 expands upwardly, the upper connecting plate 34 is caused to hit the upper plate 12*b* of the case body 11. However, since this upper connecting plate 34 is made of comparatively soft material, the upper plate 12*b* can be prevented from being broken. It should be noted that when the protective member 30 expands upwardly as mentioned, it is not necessary for the connecting plate 34 to reach the upper plate 12*b*.

Even in the state that the needle 54 pierces the lower end wall 55*b* of the high-pressure tank 55 and enters the hole B, the high-pressure gas is supplied into the protective member 30 because the high-pressure gas leaks between the needle 54 and the peripheral edge of the hole B. In this embodiment, the electromagnetic driver 63 is returned from its ON-state to its OFF-state to allow the cam rod 62 to return to its original position under the effect of the coil spring 65. The needle 54 and the cam follower 66 are then pushed downwardly under the effect of the coil spring 68 to cause the cam follower 66 to contact the low horizontal portion $62x_1$. As a consequence, the needle 54 is withdrawn from the hole B of the lower end wall 55*b*, thus more assuredly discharging the high-pressure gas.

The high-pressure tank 55 comprises a molded metal container and it does not have an opening nor a closure for covering the opening. Accordingly, the high-pressure gas is not allowed to leak at all until the high-pressure tank 55 is pierced by the needle 54. Accordingly, the high-pressure gas can be confined in a stable manner within the high-pressure tank 55 for a long period of time.

Other embodiments of the present invention will now be described. In the embodiments to be described, component parts corresponding to those of the first-described embodiment are denoted by identical reference numerals, and detailed description thereof is omitted.

Figure 8:
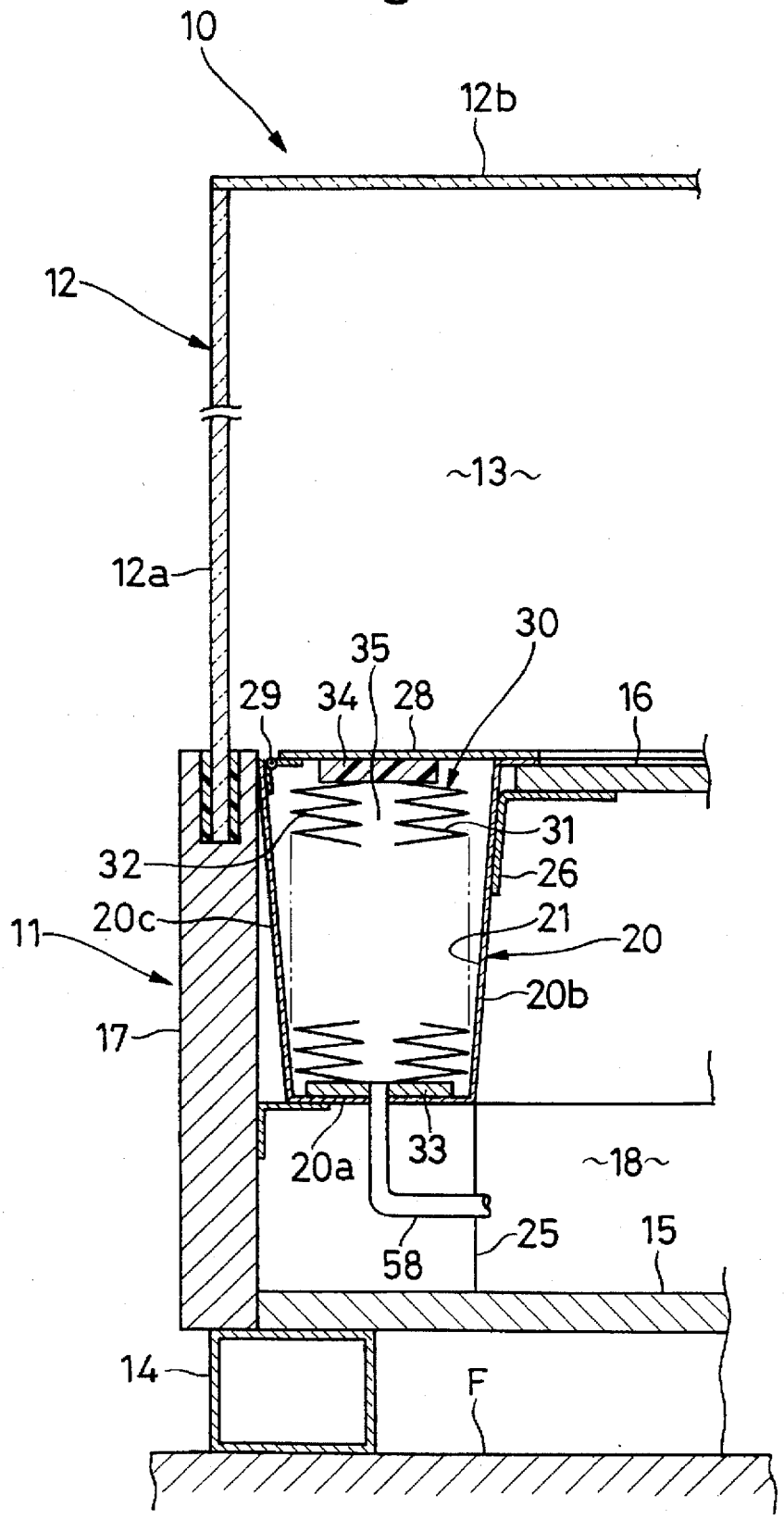
FIG. 8 is a view, similar to FIG. 3, showing another embodiment of an exhibition apparatus according to the present invention.

FIG. 8 illustrates the second embodiment of the present invention. In this second embodiment, only the construction of the receiving member 20 is different from the first embodiment. That is, the width of the receiving recess 21 becomes wider towards an upper end thereof from a lower end. Owing to this feature, the protective member 30 can more easily be received, and it can more smoothly be expanded when a high-pressure gas is supplied thereto.

Figure 9:
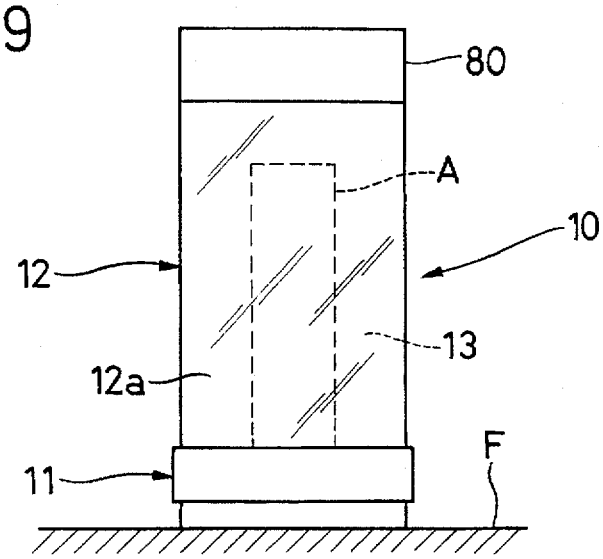
FIG. 9 is a side view showing still another embodiment of an exhibition apparatus according to the present invention.
Figure 10:
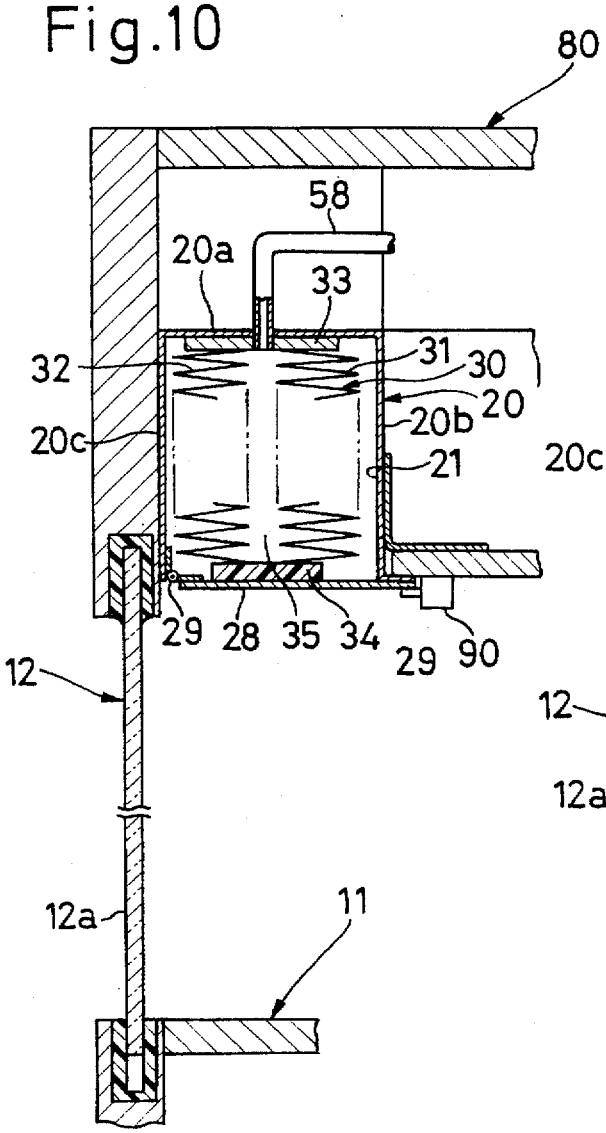
FIG. 10 an enlarged vertical sectional view showing the protective member in its contracted state.
Figure 11:
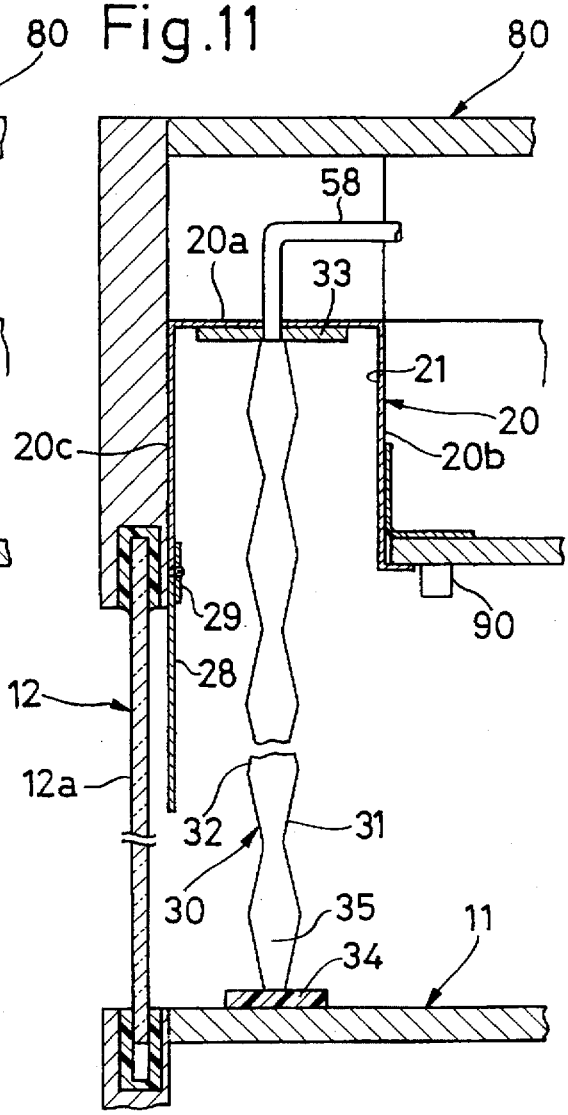
FIG. 11 is a view, similar to FIG. 10, showing the protective member but in its expanded state.

FIGS. 9 through 11 illustrate the third embodiment of the present invention. In this third embodiment, an upper part of the exhibition case 10 comprises a box 80. The protective member 30 is disposed within this box 80. This will be described in more detail. The base 11 has a simplified construction. The box 80 resembles a construction which can be obtained by placing the base 11 of the first embodiment upside down. The three side plates 12*a* of the case body 12 are secured to the box 80, and the remaining pivotable side plate 12*a* is not secured to the box 80. The protective member 30 is received in a contracted state thereof in the receiving recess 21 of the receiving member 20 which is disposed within the box 80. The lower end opening of the receiving recess 21 of the receiving member 20 is closed by the closures 28. One edges of the closures 28 are pivotably supported by a lower edge of the outer erected wall 20*a* of the receiving member 20 by the hinge 29. The other edges of the closures 28 are latched by the latch mechanism 90 (actuation means) which is mounted on a lower surface of the box 80, so that the closures 28 are held in their closed positions. The closures 28 are located at a level generally equal to the lower surface of the box 80. Within the box 80, the detector 40 and the actuation mechanism 50 shown in FIG. 2 are received.

With the above-mentioned construction, a shaking detection signal of the detector 40 is sent first to the latch mechanism 90 and then to the electromagnetic driver 63 (see FIG. 2) with a slight delay of time. In response to the detection signal from the detector 40, the latch mechanism 90 unlatches the closure 28. As a consequence, the closures 28 open the receiving recess 21. Consequently, the contracted protective member 30 drops by its dead weight and is vertically expanded to surround the exhibit A. Immediately after the dropping of this member 30, the electromagnetic driver 63 is driven to supply the high-pressure gas into the closed space 35 in the protective member 30 to expand the protective member 30 in its width direction.

The following embodiments are also acceptable.

In any of the above embodiments, although the inner bellows 31 and the outer bellows 32 of the protective member 30 are spaced apart from each other, an outer folding line portion of the inner bellows 31 may contact an inner folding line portion of the outer bellows 32. In that case, the folding line portions may be bonded together by adhesives spacedly applied thereto along the folding lines. By doing this, the protective member 30 can be prevented from expanding in its width direction at a vertically intermediate part thereof.

In the above first and second embodiments, if a large quantity of gas enough for assuredly expanding the protective member 30 can be obtained, only one high-pressure tank 55 is good enough.

The connecting plate 34 of the protective member 30 may also serve as a closure for closing the upper end opening of the receiving recess 21.

The protective member may comprise a bag such as a safety air bag for automotive vehicles.

The protective member may comprise a single sleeve-like bellows. In that case, the actuation mechanism is constructed, for example, as follows. An upper end of the bellows is secured to upper end portions of a plurality of rods which are vertically arranged. The rods are upwardly biased by springs and held in their lower positions by stoppers. In response to the shaking detection from the detection means at the time of earthquake, the stoppers are moved to disengage the rods. As a consequence, the rods are moved upwardly to expand the bellows in its width direction. The actuation mechanism may include an air cylinder instead of the rods and stoppers, which air cylinder is driven by high-pressure gas.

The protective member may be divided and arranged in a circumferential direction around the exhibit.

The exhibition case and the protective member may be circular in plan view.

The means for discharging the high-pressure gas from the high-pressure tank may be a valve located at an intermediate portion of a tube connecting the protective member to the high-pressure tank.

It may be arranged, as in the case with the air bag for automotive vehicles, such that the high-pressure gas is supplied by igniting explosive powder under heating. In that case, the explosive powder serves as a high-pressure gas supply source, and the actuation means comprises this explosive powder, a heater for heating the explosive powder, and a driver circuit for turning on the heater in response to a detection signal from the detector.

The means for detecting the shaking, may be arranged outside the exhibition case (for example, on the floor). In that case, by detecting the shaking of the floor, the shaking of the exhibition case is indirectly detected. The detection means may detect a vertical shaking, or both the vertical and horizontal shakings of the exhibition case at the same time.

The shaking detection means may comprise a horizontal moving plate, and a receiving base adapted to receive this horizontal moving plate. Balls are rotatably supported at plural locations of a lower surface of the horizontal moving plate, and receiving surfaces, on which the balls are to be placed, are formed on an upper surface of the receiving base. Each of the receiving surfaces has a concave surface consisting of a part of a spherical surface having a larger radius of curvature than the ball. Normally, the balls are located at the center of the receiving surfaces, respectively. When an earthquake occurs, the horizontal moving plate is moved in a horizontal direction and the balls are offset from the central position of the receiving surfaces. This horizontal movement of the horizontal moving plate indicates the detection of shaking of the exhibition case. For example, the horizontal moving plate is provided at a peripheral edge portion thereof with a blade. When the horizontal moving plate moves an amount larger than a predetermined amount, the blade cuts a rubber tank containing water. Then, a valve is opened by a trigger which receives the water coming from the interior of the tank to supply a high-pressure gas within the high-pressure tank into the closed space in the protective member.

What is claimed is:

1. An exhibition apparatus comprising:

(a) an exhibition case having a peripheral wall surrounding an exhibit;

(b) expansible protective means disposed in a contracted state thereof selectively at an upper part or a lower part of said exhibition case and inwardly of said peripheral wall of said exhibition case, said protective means surrounding said exhibit when said protective means expands in a vertical direction;

(c) detection means for detecting a larger shaking of said exhibit case than a predetermined level; and (d) actuation means for expanding said protective means in response to the detection of shaking made by said detection means.

2. An exhibition apparatus according to claim 1, in which said exhibition case further includes a base on which said exhibit is placed, said base being provided as said lower part of said exhibition case and adapted to support thereon said peripheral wall, a receiving recess being formed in an upper surface of said base in such a manner as to surround an area on which said exhibit is placed, said protective means being received in a contracted state thereof in said receiving recess.

3. An exhibition apparatus according to claim 2, in which an upper end opening of said receiving recess is closed by a closure, said closure being pushed by said protective means to open said upper end opening when said protective means is expanded upwardly.

4. An exhibition apparatus according to claim 1, in which said upper part of said exhibition case comprises a box, said box being supported by said peripheral wall, a receiving recess being formed in a lower surface of said box and extending along said peripheral wall, said protective means being received in a contracted state thereof in said receiving recess, a lower end opening of said receiving recess being closed by a closure, said closure being latched by a latch mechanism provided as actuation means, said latch mechanism unlatching said closure in response to detection of shaking from said detection means and opening said closure to allow said protective means to expand downwardly.

5. An exhibition apparatus according to claim 1, in which said protective means includes a bellows.

6. An exhibition apparatus according to claim 1, in which said protective means has a closed space and said actuation means includes a high-pressure gas supply source, and a tube for connecting said supply source to said protective means, said actuation means feeding a high-pressure gas in said high-pressure gas supply source into said dosed space in said protective means through said tube.

7. An exhibition apparatus according to claim 6, in which said protective means includes an inner bellows, an outer bellows disposed in such a manner as to surround said inner bellows.

8. An exhibition apparatus according to claim 6, in which said high-pressure gas supply source of said actuation means comprises a tank confining therein a high-pressure gas, said detection means outputting an electrical detection signal when said detection means detects shaking of said exhibition case, said actuation means feeding the high-pressure gas in said tank into said tube in response to the detection signal from said detection means.

9. An exhibition apparatus according to claim 8, in which said tank has a thin wall portion, and said actuation means has a holder for holding said tank such that said holder co-acts with said thin wall portion of said tank to define an internal space, said internal space being in communication with said closed space in said protective means through said tube, said actuation means further including a needle held by said holder with a sharp distal end thereof disposed in said internal space, said needle being placed opposite said thin wall portion, and a needle moving mechanism for moving said needle towards said thin wall portion in response to the detection signal from said detection means, so that said needle breaks into said thin wall portion to define a hole.

* * * * *

UNITED STATES PATENT AND TRADEMARK OFFICE

CERTIFICATE OF CORRECTION

PATENT NO. : 5,671,984

DATED : September 30, 1997

INVENTOR(S) : Kodera

It is certified that error appears in the above-identified patent and that said Letters Patent is hereby corrected as shown below:

In the Claims:

In Claim 6, line 6, "dosed" should read --closed--

Signed and Sealed this

Eleventh Day of August 1998

Bruce Lehman

*Attest:*

BRUCE LEHMAN

*Attesting Officer*

*Commissioner of Patents and Trademarks*